US005650085A

United States Patent [19]

Chen

[11] Patent Number: 5,650,085

[45] Date of Patent: Jul. 22, 1997

[54] COOKING TRAY FOR MICROWAVE OVEN

[75] Inventor: Jack Chen, Changhua, Taiwan

[73] Assignee: Yinn Haur Co., Ltd., Chang-Hua, Taiwan

[21] Appl. No.: 570,933

[22] Filed: Dec. 12, 1995

[51] Int. Cl.[6] ..... H05B 6/80

[52] U.S. Cl. ..... 219/732; 219/233; 99/DIG. 14; 99/421 HV; 99/421 H; 99/448

[58] Field of Search ..... 219/732, 733, 219/762, 763; 99/421 H, 421 HH, 421 HV, 399, 427, 448, DIG. 14

[56] References Cited

U.S. PATENT DOCUMENTS

| | | | |
|---|---|---|---|
| 4,074,102 | 2/1978 | Asen | 219/732 |
| 4,559,869 | 12/1985 | Hogan | 99/448 |
| 4,598,690 | 7/1986 | Hsu | 99/421 H |
| 4,748,308 | 5/1988 | Drews | 219/732 |
| 4,933,528 | 6/1990 | Barr | 219/732 |
| 5,552,585 | 9/1996 | Fleck et al. | 219/732 |

*Primary Examiner*—Philip H. Leung

[57] ABSTRACT

An improved cooking tray for microwave oven has a tray body and a plurality of supporting racks, separating racks, and skewers for supporting foods such as meat or bread for toasting and cooking in a microwave oven. By way of the transverse and longitudinal inserting seats disposed on the base of the tray body, the supporting and separating racks can be assembled to the tray body to hold the food to be toasted or cooked on the cooking tray. When meat is to be toasted, the meat slices can be put in the guiding slots formed by the separating plates aligning with and parallel to each other and extending upwardly on the base of the separating rack. And a skewer supporting the meat slices can be suspended upon a pair of the skewer openings at the top of the supporting racks in accordance with the size of the meat slices. Furthermore, the cooking tray can be provided with different top and bottom sides for use with certain foods to be cooked or warmed in the microwave oven.

1 Claim, 5 Drawing Sheets

COOKING TRAY FOR MICROWAVE OVEN

BACKGROUND OF THE INVENTION

The present invention relates to an improved cooking tray for microwave oven, especially to a cooking tray comprising a tray body, and a plurality of supporting racks, separating racks, and skewers for toasting and cooking foods such as meat and bread of different shapes and sizes in a microwave oven.

A conventional cooking tray for microwave oven is in the prior art of U.S. Pat. No. 4,933,528 are the following drawbacks:

1. The separator plate 20 and the cooking tray 10 are integrally molded, making the grease and dregs of left over meat on the skewer opening 24 and the dead corner of the chinks difficult to clean. This is highly un-hygienic.
2. The direction and location of the cited skewer opening 24 is not optimum in design because it is difficult to disengage the product from the mold when it is integrally molded.
3. The device cannot support food or meat of other shapes for toasting and cooking except stripped meat. Besides, the skewer openings 24 of the separator plate 20 are located at a certain height while the meat to be toasted are of different sizes. When a large piece of meat is to be toasted, the fixed location of the skewer opening 24 will make part of the toasted meat shrink. It is, therefore, quite unsuitable for a fixed skewer opening 24 to support meat of different sizes.

To improve the above shortcomings of the conventional device cited above, the present invention endeavors to provide an improved cooking tray having a plurality of assembling supporting racks and separating racks and more than one skewer opening, and with each at a different height, for supporting foods such as meat and bread of different shapes and sizes for toasting and cooking in a microwave oven and which can also be disassembled for easy cleaning and maintenance.

SUMMARY OF THE INVENTION

The primary object of the present invention is to provide an improved cooking tray for microwave oven, comprising a tray body and a plurality of supporting racks, separating racks, and skewers, which, by means of the transverse and longitudinal inserting seats disposed on the base of the tray body, can be assembled to support foods such as meat and bread of different shapes and sizes for toasting and cooking in a microwave oven and which disassembled for easy cleaning and washing when not in use.

DETAILED DESCRIPTION OF THE PREFERRED EMBODIMENT

Figure 1:
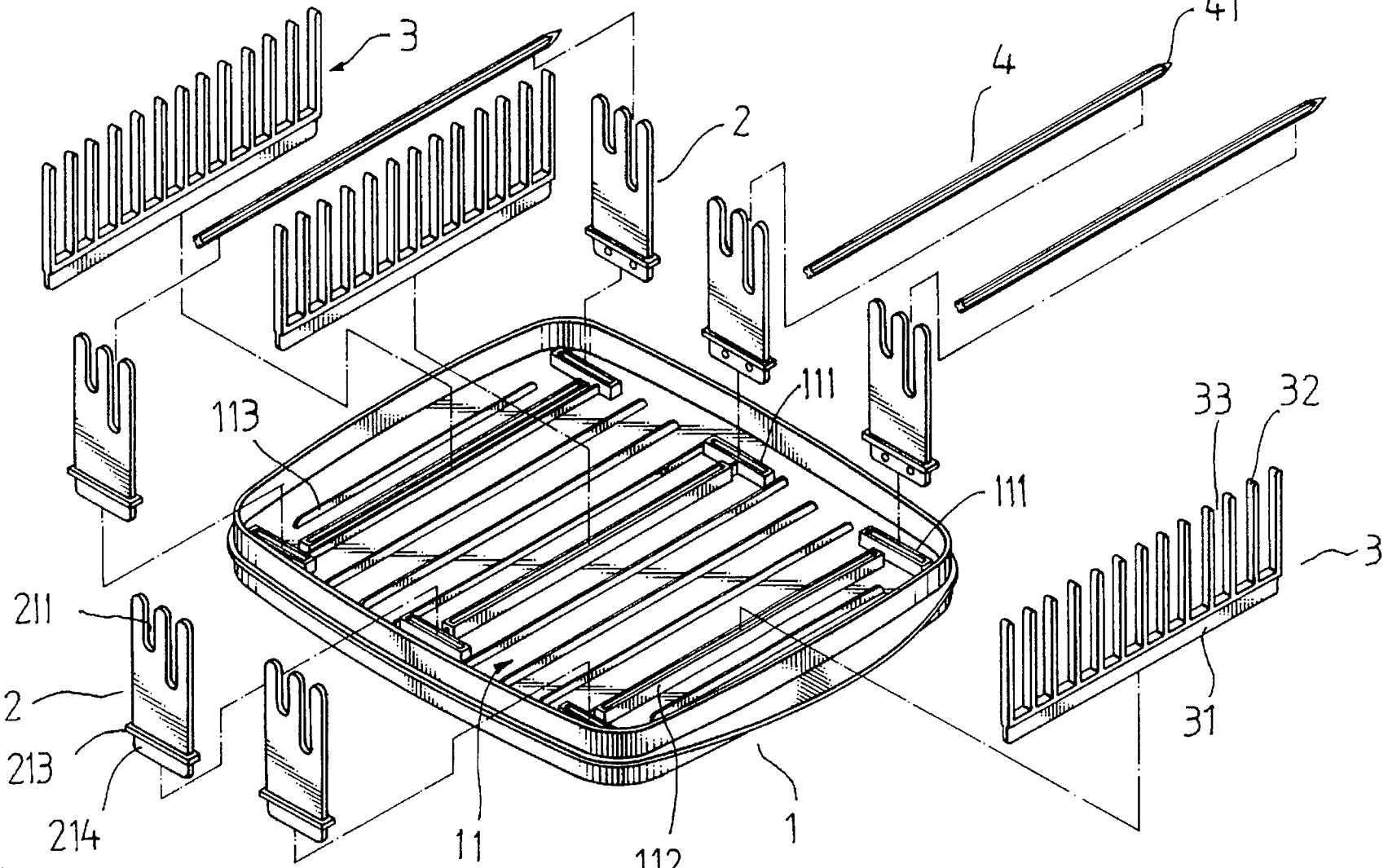
FIG. 1 is a perspective exploded view of the present invention.

Please refer to FIG. 1. The present invention relates to an improved cooking tray for microwave oven, comprising a tray body 1 and a plurality of supporting racks 2, separating racks 3, and skewers 4 for toasting and cooking foods such as meat and bread of different shapes and sizes in a microwave oven.

The tray body 1 has a base 11 upon which plural pans of opposed transverse inserting seats 111 are provided at both lateral sides. Between each, pair of the transverse inserting seats 111 is disposed a longitudinal inserting seat 112. A plurality of protruding ribs 113 are disposed upon the surface of the base 11 between seats 112.

A plurality of supporting racks 2 are provided. At the top of each supporting rack are disposed two skewer openings 211, each defining a different depth. At the bottom of each supporting racks is provided a stopping flange 213 having an insertion portion 214 disposed therebelow.

A plurality of separating racks 3 are provided, each rack 3 having a longitudinal base 31 upon which several separating plates 32, aligned with and parallel to one another, extend upwardly, thus defining a guiding slot 33 between each pair of adjacent plate 3.

A plurality of skewers 4 are provided, each forming a slim column with a sharp point disposed at the front end thereof.

Figure 2:
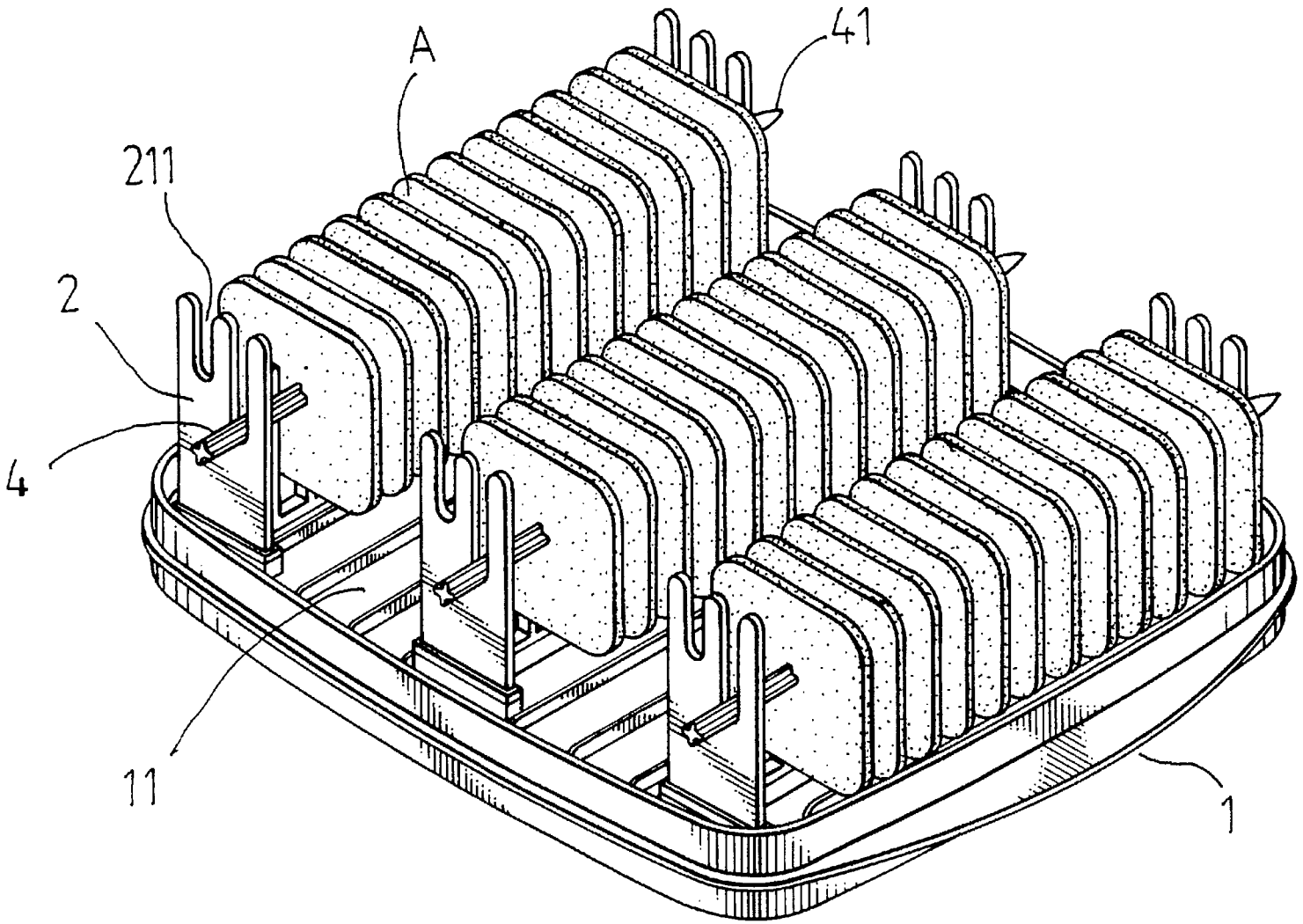
FIG. 2 is an assembled perspective view of the present invention in practical use.

When slices of meat A are to be toasted, the above-mentioned elements can be assembled in such a way as to provide an excellent cooking tray for toasting meat in a microwave oven. At least two pieces of the supporting rack 2 are first inserted correspondingly front to rear into a pair of the transverse opposed inserting seats 111 disposed on the base 11 of the cooking tray 1. Then the longitudinal base 31 of a separating rack is inserted into the longitudinal inserting seat 112. The meat slices A can then be placed in alignment into the guiding slots 33 formed by the separating plates 32. The sharp end 41 of a skewer 4 can be passed through the meat slices A to fix the meat on the supporting rack 2. Finally both ends of the skewer 4 pierced with meat slices A can be suspended on the skewer openings 211 for the meat slices to be toasted in a microwave oven as shown in FIG. 2. Furthermore, due to the multiple skewer openings 211, each defining a different depth, the location to place the skewer 4 can be properly chosen in accordance with the size of the meat slices A.

Figure 3:
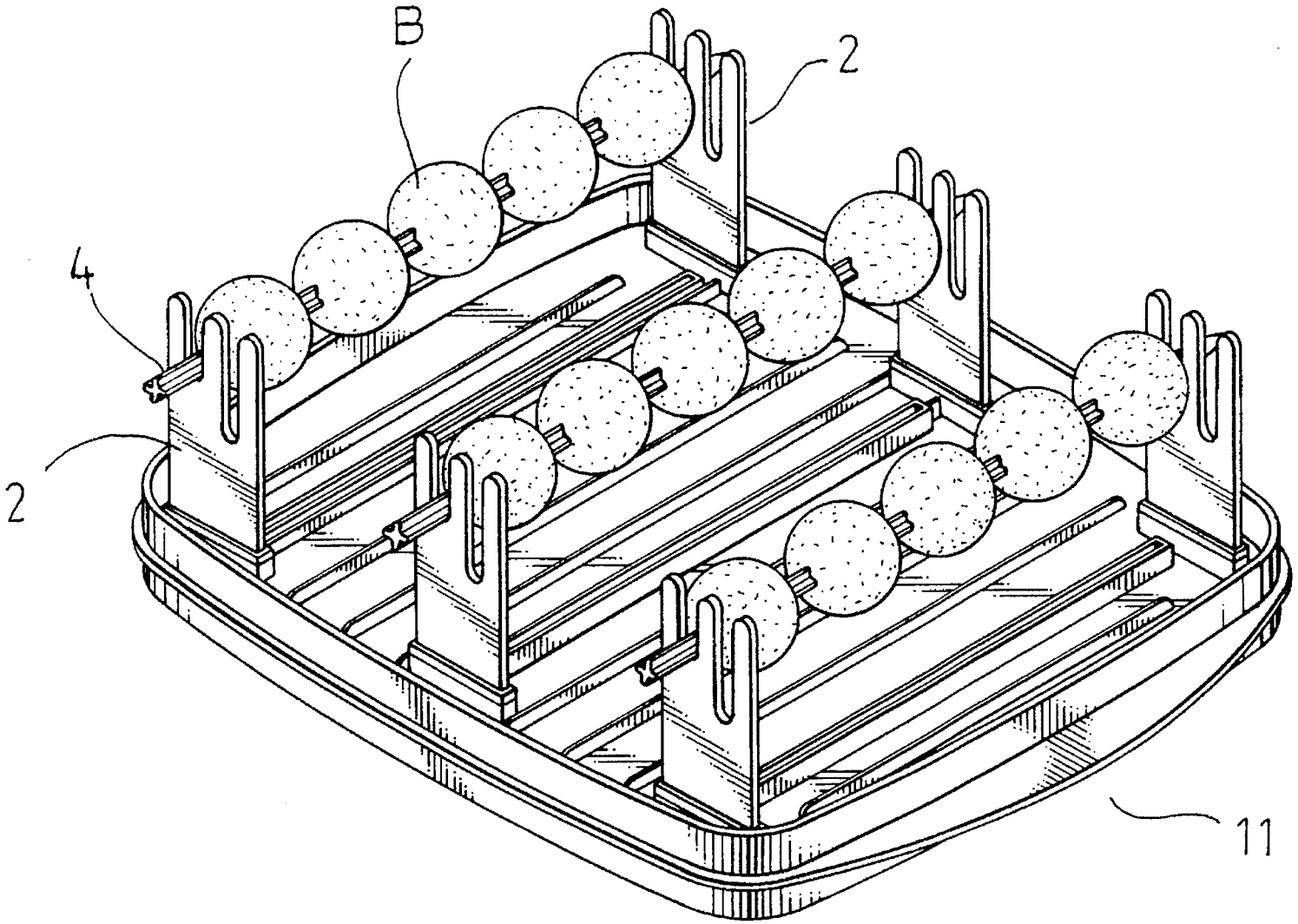
FIG. 3 is another assembled perpective view of the present invention in practical use.

Please refer to FIG. 3. When something such as meat balls B are to be toasted in a microwave oven, the separating rack 3 is first dis-engaged from the longitudinal inserting seat 112 and removed from the base 11 of the cooking tray 1. Then the skewer 4 can thread through the meat balls B to align them together. Both ends of the skewer 4 are then suspended on the properly chosen skewer opening 211 for the meat balls to be toasted in a microwave oven.

Figure 4:
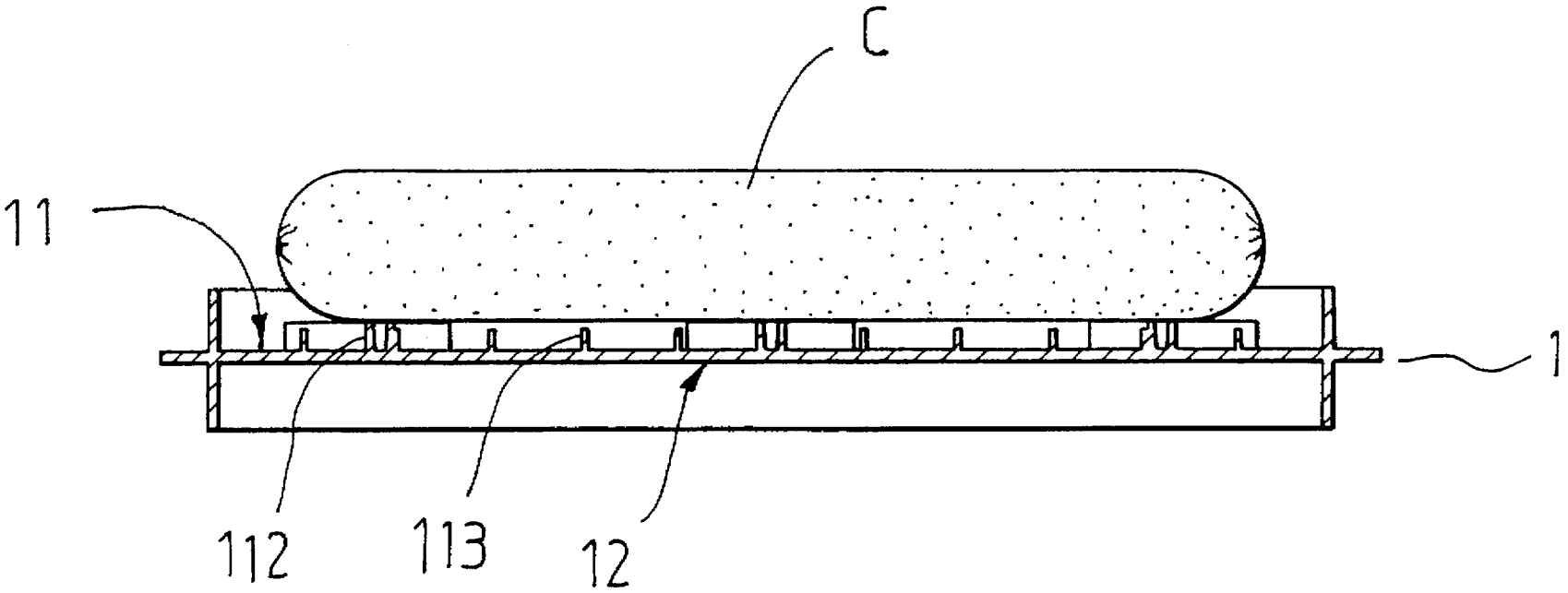
FIG. 4 is a sectional view of the present invention in practical use.
Figure 5:
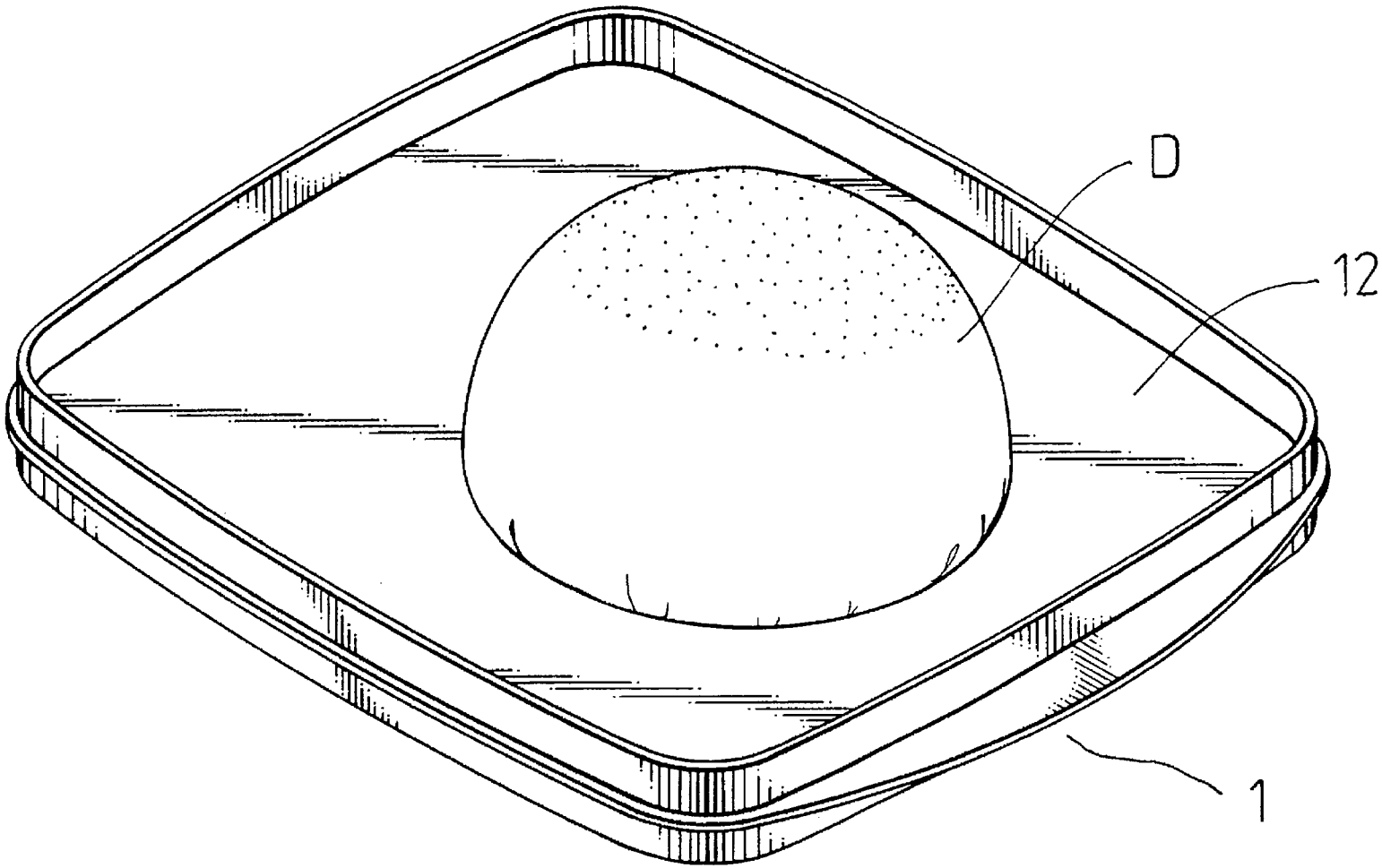
FIG. 5 is a third pespective view of the present invention in practical use.

Please refer to FIGS. 4 and 5. The cooking tray 1 can be provided with two different surfaces, both the top and the bottom sides 11, 12 simultaneously, in accordance with the shape and characteristic of the foods to be toasted or cooked in the microwave oven. When the food to be cooked is strip-like such as a hot dog or sausage C, the top side 11 of the cooking tray 1 is a proper choice. The several inserting seats 111, 112 and the protruding ribs 113 disposed on the surface of the top side 11 can prevent food C from direct contact with the surface of the cooking tray 1 so that the food C will not get burned easily. On the contrary, when some foods of large size such as toast or bread D are to be baked or warmed in the microwave oven, the flat surface of the bottom side 12 can be used to better bake food D.

What is claimed is:

1. A tray for cooking articles of food in a microwave oven comprising:

a) a tray body including a base having thereon at least one pair of spaced transverse inserting seats, a longitudinal inserting seat extending between the pair of transverse inserting seats, and a plurality of spaced protruding ribs;

b) a pair of supporting racks, each supporting rack including a plurality of skewer openings at different heights corresponding to the skewer openings of the other supporting rack for selectively supporting a skewer therebetween at different heights, a stopping flange and an insertion portion extending below the stopping flange, the insertion portion being detachably receivable within one of the transverse inserting seats, c) an elongate skewer having at least one sharp end for skewering food articles, the skewer being engageable within corresponding skewer openings of the supporting racks for supporting the skewered food articles therebetween at a selected height; and d) at least one separating rack including a longitudinal base detachably receivable within the longitudinal inserting seat and a plurality of spaced separating plates extending upwardly from the longitudinal base, the separating plates defining a plurality of guiding slots therebetween for receiving plural articles of food and permitting the articles of food to be maintained in position through skewering of same by the skewer supported between the supporting racks at the selected height.

* * * * *